US007850172B2

(12) United States Patent
Best

(10) Patent No.: US 7,850,172 B2
(45) **Date of Patent: *Dec. 14, 2010**

(54) THREE-DIMENSIONAL PUZZLE

(75) Inventor: Phillip J. Best, 1096 Autumn Hill Ct., Crozet, VA (US) 22932

(73) Assignee: Phillip J. Best, Crozet, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/506,595

(22) Filed: Jul. 21, 2009

(65) Prior Publication Data

US 2009/0273140 A1 Nov. 5, 2009

Related U.S. Application Data

(63) Continuation of application No. 11/678,715, filed on Feb. 26, 2007, now Pat. No. 7,584,961.

(51) Int. Cl.
*A63F 9/04* (2006.01)

(52) U.S. Cl. ..... 273/145 CA; 273/145 C; 273/145 R; 273/138.1

(58) Field of Classification Search ..... 273/145 R, 273/145 A, 145 B, 145 C, 143 R, 138.2, 145 CA, 273/138.1

See application file for complete search history.

(56) References Cited

U.S. PATENT DOCUMENTS 4,034,986 A 7/1977 Weidner
4,061,338 A * 12/1977 Goldberg ..... 273/144 B
4,108,431 A * 8/1978 Camara ..... 273/459
4,306,868 A 12/1981 Hankins
4,378,116 A 3/1983 Rubik
4,378,118 A 3/1983 Leonardi, Jr.
4,560,164 A 12/1985 Darling
4,708,345 A 11/1987 Ayers
5,074,560 A 12/1991 Silverman
5,344,145 A * 9/1994 Chadwick et al. ..... 463/31
5,520,393 A 5/1996 Rickey, Jr.
5,547,198 A 8/1996 Kaiser
6,186,504 B1 2/2001 Maxim
6,464,508 B1 10/2002 Ryan
6,523,825 B2 2/2003 Francis

* cited by examiner

*Primary Examiner*—Benjamin H Layno
(74) *Attorney, Agent, or Firm*—Wood, Herron & Evans, L.L.P.

(57) ABSTRACT

An apparatus includes a multisurfaced object having at least a first surface and a second surface, with at least a first symbol disposed on the first surface and a second symbol disposed on the second surface. The apparatus also includes a container having an interior compartment and an opening in the container, wherein the multisurfaced object is positioned within the interior compartment, and at least the first surface is visible through the opening. The apparatus further comprises a mechanism associated with the multisurfaced object, adapted to rotate the multisurfaced object such that the second symbol is visible through the opening.

13 Claims, 10 Drawing Sheets

THREE-DIMENSIONAL PUZZLE

CROSS-REFERENCE TO RELATED APPLICATION

This application is a continuation of, and claims the benefit of the filing date of, U.S. patent application Ser. No. 11/678,715, filed on Feb. 26, 2007, now U.S. Pat. No. 7,584,961, issued on Sep. 8, 2009, by Phillip J. Best, and entitled "Three-Dimensional Puzzle," the disclosure of which is incorporated herein by reference in its entirety.

FIELD OF THE INVENTION

The present invention relates to amusement and test devices and, more specifically, relates to such devices of the manipulative type for use in providing puzzles, tests for spatial logic, and the like.

BACKGROUND OF THE INVENTION

People have long been fascinated, entertained, and enlightened by logic-based puzzles. The enormous variety of such puzzles may provide delight to both children and adults. Though a number of factors relate to the enjoyability of a particular logic-based puzzle for a particular person, the level of complexity, the configurability of the pieces, and the presence of colors, symbols, and/or sounds may all contribute.

Further, apart from their use as devices for entertainment, logic-based puzzles may be used to test the spatial reasoning or logic of individuals. Studies have confirmed that analytical thought of the type elicited by such logic-based puzzles can improve one's capacity for learning and recalling information. Such tests may help determine individuals suited for a particular task, or train individuals for a particular task. For example, individuals who are candidates to be astronauts need to have a tremendous aptitude for spatial reasoning. This is because much of a routine, Earth-based analysis of various objects is based on an individual's relationship to those objects, as determined by one or more points of reference (such as the Earth's gravity). However, in space, many of these variables (e.g., gravity, or other points of reference) may not exist. Thus, the ability of an individual to understand the orientation of various objects when no standard point of reference exists can be critical.

Of the many types of logic-based puzzles, one example that is known is a 4×4 square grid having fifteen slidable tiles numbered 1-15 occupying fifteen of the sixteen spaces within the grid. Tiles can be slid sequentially into the empty space in the grid, thereby altering the relative positions of the numbered tiles. The typical solution to such a puzzle is obtained when the tiles are numerically ordered 1-15 reading left-to-right across the columns and then down the rows, for example.

Another well-known logic-based puzzle is the Rubik's Cube®. This cube-shaped puzzle has six faces each including a 3×3 grid of nine colored stickers. The stickers adhere to 26 plastic pieces emanating radially from a central core. The various perpendicular planes of eight or nine pieces are rotatable about the central core to reconfigure the cube and the arrangement of stickers thereon. The typical solution to this puzzle is obtained when all nine stickers on each face are of identical color and each of the six faces of the cube has stickers of a different color from each of the other five faces.

These and many other logic-based puzzles use recognizable patterns of colors, letters, numbers, and the like to distinguish a "solution state" from a "non-solution state." Such puzzles can be used to challenge the player's ability to form and remember spatial relationships in three dimensions. However, in each of the puzzles described above, the player can observe all of the puzzle pieces, or all sides of the cube at once, before deciding on a next "move" to make. In other words, many present puzzles allow the user to see alternative sides of the puzzle pieces by rotating the entire puzzle. They do not require the individual to remember the spatial relationship among the faces of the object, in three-dimensional space. Thus, they cannot be used to ultimately test all spatial reasoning abilities. Thus, a puzzle that allows for such testing of an individual would be desirable.

SUMMARY OF THE INVENTION

In accordance with the invention there is provided a puzzle apparatus for providing a user with a challenging puzzle to solve. Further, the nature of the game is particularly for challenging spatial reasoning and testing an individual's aptitude therefore. Certain exemplary aspects of the invention are set forth below. It should be understood that these aspects are presented merely to provide the reader with a brief summary of certain forms the invention might take and that these aspects are not intended to limit the scope of the invention. Indeed, the invention may encompass a variety of features and aspects that may not be set forth below.

The game includes a plurality of symbols, including at least a first symbol and a second symbol, and a display apparatus adapted to display only one of the plurality of symbols at a time. The game further includes a mechanism that can be activated by a user, to alter the symbol that is visible on or in the display apparatus. Thus, the first symbol is visible on or in the display apparatus prior to activation of the mechanism, and the second symbol is visible on or in said display apparatus after activation of the mechanism. Activation of the mechanism may occur once or multiple times before the second symbol is visible. The display apparatus may be a computer or computer screen, such that the game may be played on a computer. Alternatively, the display apparatus may be part of a hand-held apparatus that is used to play the game.

For example, such a hand-held apparatus may include a container having at least one interior compartment, and a multisurfaced object positioned within the interior compartment. The multisurfaced object includes at least a first surface and a second surface having at least a first symbol disposed on the first surface and a second symbol disposed on the second surface. An opening is provided in the container, such that only one surface, such as the first surface, is visible through the opening at any given time. Thus, the opening may be akin to the display screen described above. The apparatus further includes a mechanism associated with the multisurfaced object, wherein the mechanism is adapted to rotate the multisurfaced object.

In one particular embodiment, the puzzle includes a cylinder containing a three-dimensional object, such as a cube, made up of 6 square surfaces. The object might also be a dodecahedron, made up of 12 pentagonal surfaces, or an icosahedron, made up of 20 triangular surfaces. The cube has a different identifying figure, or symbol, on each of its surfaces. The player looks through an opening in the top of the cylinder and sees one surface of the cube, which contains a specific identifying figure. The player's task is to rotate the cube so a new specified surface is visible through the opening. One object may be to accomplish the task with as few moves as possible. This variable can be used to test the aptitude of the individual for spatial reasoning. Thus, the apparatus presents a challenging logic-based puzzle wherein the user attempts to move the multisurfaced object from a position where a first symbol is visible to a position where a second symbol is visible.

The cylinder may be equipped with at least one mechanism, such as a handle or lever, for example, to permit the player limited rotation of the cube by manipulating the mechanism outside of the cylinder. Further, the player may be permitted limited rotation of the cube in two planes, by providing two mechanisms (such as levers). The levers may be operatively connected to mechanisms inside the cylinder for rotating the cube in the horizontal plane and in one vertical plane, for example. Alternatively, the levers may rotate the cube in two vertical planes.

Various refinements exist of the features noted above in relation to the various aspects of the present invention. Further features may also be incorporated in these various aspects as well. These refinements and additional features may exist individually or in any combination. For instance, various features discussed below in relation to one or more of the illustrated embodiments may be incorporated into any of the above-described aspects of the present invention alone or in any combination. Again, the brief summary presented above is intended only to familiarize the reader with certain aspects and contexts of the present invention without limitation to the claimed subject matter.

BRIEF DESCRIPTION OF THE DRAWINGS

The accompanying drawings, which are incorporated in and constitute a part of this specification, illustrate embodiments of the invention and, together with the general description of the invention given above and the detailed description of the embodiments given below, serve to explain the principles of the present invention.

DETAILED DESCRIPTION OF THE INVENTION

Figure 1:
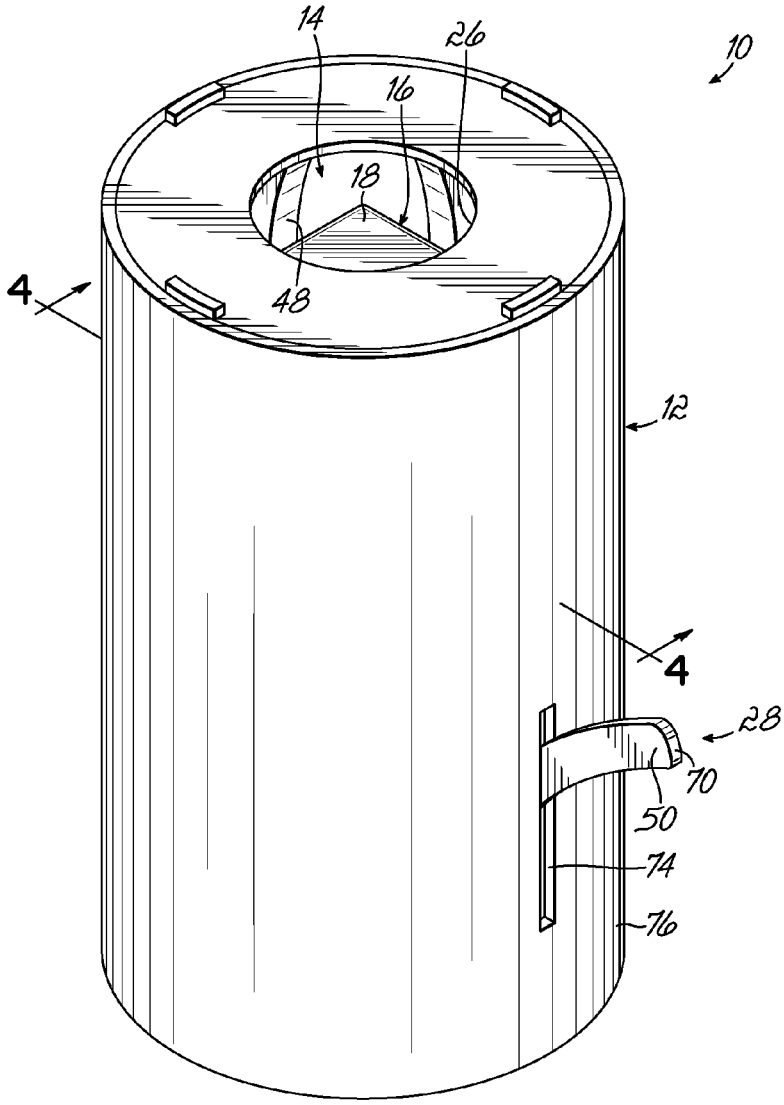
FIG. 1 is an isometric view of a first embodiment of the invention.

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, which may vary from one implementation to another. Moreover, it should be appreciated that such a development effort might be complex and time-consuming, but would nevertheless be a routine undertaking of design, fabrication, and manufacture for those of ordinary skill having the benefit of this disclosure.

Referring now to the Figures, the present invention provides a puzzle or game apparatus for providing a user with a challenging puzzle or game to solve, and a game that is particularly useful for testing spatial reasoning or logic. Particularly, the game includes a plurality of symbols, including at least a first symbol and a second symbol, and a display apparatus adapted to display only one of the plurality of symbols at a time. The game further includes a mechanism that can be activated by a user, to alter the symbol that is visible on the display apparatus. Thus, the first symbol is visible on or in the display apparatus prior to activation of the mechanism, and the second surface is visible on or in the display apparatus after activation of the mechanism. The display apparatus may be a computer or computer screen, such that the game may be played on a computer. Alternatively, as described above in the Summary of the Invention, the display apparatus may be part of a hand-held apparatus.

Thus, in one embodiment, as shown in FIGS. 1-9, the apparatus 10 includes a container 12 having at least one interior compartment 14, and a multisurfaced object 16 positioned within the interior compartment 14. The multisurfaced object 16 includes at least a first surface 18 and a second surface 20 having at least a first symbol 22 disposed on the first surface 18 and a second symbol 24 disposed on the second surface 20. An opening 26 is provided in the container 12, such that at least the first surface 18 is visible through the opening 26. Thus, the opening 26 may be akin to the display screen described above. The apparatus 10 further includes a first mechanism 28 associated with the multisurfaced object 16, wherein the first mechanism 28 is adapted to rotate the multisurfaced object 16 in a first plane.

Figure 2:
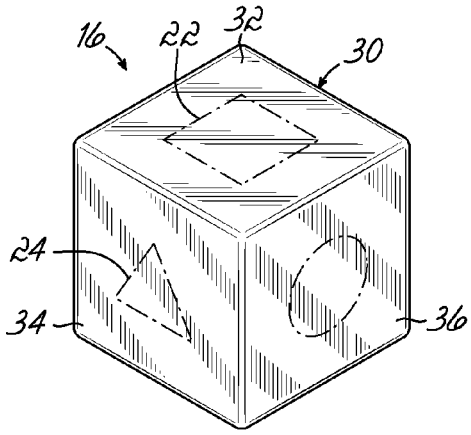
FIG. 2 is an isometric view of a multisurfaced object, in particular a cube, depicting the top, front, and right sides.
Figure 3:
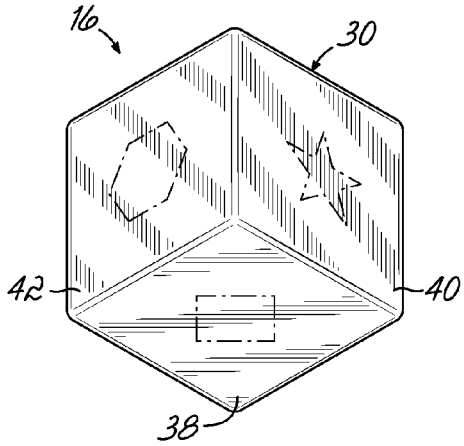
FIG. 3 is an isometric view of the multisurfaced object of FIG. 2, depicting the bottom, rear, and left sides.

Thus, as in the illustrated embodiment, the puzzle includes a cylindrical container 12 containing a three-dimensional object. One example of such an object is a cube 30, as shown in FIGS. 2 and 3. The cube 30 has six sides: a top side 32, front side 34, right side 36, bottom side 38, rear side 40, and left side 42. The cube 30 has a different identifying figure, or symbol, on each of its sides 32, 34, 36, 38, 40, 42. The player looks through the opening 26 in the top of the container 12 and sees one surface of the cube 30, which contains a specific identifying figure. The opening 26 in the top of the cylinder is sized and shaped such that only one surface of the multisurfaced object 16 is visible at any one time. The cube 30 may be rotated so that a new surface, and thus a new symbol, is visible through the opening 26. Thus, one of these symbols would be the first symbol 22, and one of these symbols would be the second symbol 24, described above.

While the above description and the illustrated embodiment, describe and depict the container 12 as a cylinder and the multisurfaced object 16 as a cube 30, it will be recognized by those skilled in the art that containers 12 of shapes other than cylinders, and multisurfaced objects 16 other than cubes 30 can be used in accordance with the principles of the present invention. For example, the multisurfaced object 16 may be a dodecahedron, an icosahedron, or another shape. And thus, it will be further recognized by those skilled in the art that the multisurfaced object 16 may include more than first and second symbol 22, 24 associated therewith. Rather, it may include any number of symbols. Further, the opening 26 in the container 12 may be "open," like an aperture as shown in the illustrated embodiment. Alternatively, the opening 26 may be "closed," such as by a window or other transparent substance. In an embodiment where the opening 26 is "open," it may be possible for a user to manipulate the multisurfaced object 16 using one's fingers. However, the apparatus 10 may also include a separate mechanism or mechanisms for manipulating the multisurfaced object 16, regardless of whether the opening 26 is "open" or "closed."

As in the illustrated first embodiment, the apparatus 10 includes a first mechanism 28 adapted to move the multisurfaced object 16. In particular, and referring to FIGS. 4-7, the first mechanism 28 may move the multisurfaced object 16 between a first object position (shown in FIG. 4) and a second object position (shown in FIG. 7). Thus, a first surface 18, including a first symbol (not shown in FIG. 4), is visible through the opening 26 in the first object position, and a second surface 20, including a second symbol (not shown in FIG. 7), is visible through the opening 26 in the second object position. The opening 26 is adapted such that when the first symbol 22 is visible through the opening 26, the second symbol 24 is not visible through the opening 26. The movement of the multisurfaced object 16 between the first object position and the second object position may be a rotational movement between the first object position and the second object position. Such motion will be described in greater detail below. However, those skilled in the art will recognize that such rotational movement is not necessary to the present invention, and any movement that suffices to move the multisurfaced object from the first object position to the second object position will suffice.

Figure 4:
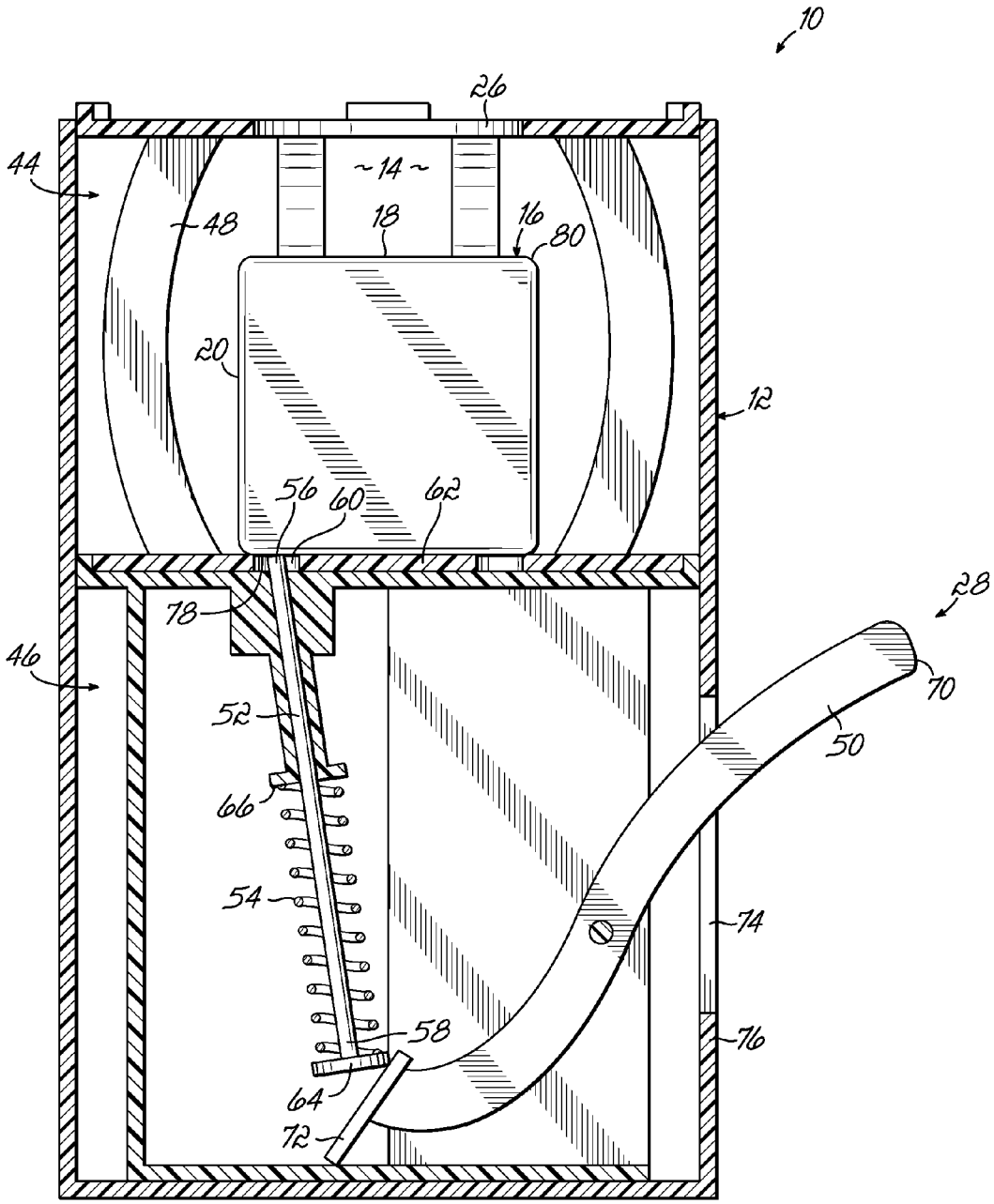
FIG. 4 is a cross-section, taken along line 4-4 of FIG. 1, showing a mechanism for moving a multisurfaced object in a first plane, such as a vertical plane.

More specifically, the first mechanism 28 is adapted to move the multisurfaced object 16 in a first plane when activated. As referred to herein, the first plane is a plane that intersects the multisurfaced object 16 as it moves from the first object position to the second object position. Thus, the surface having the first symbol and the surface having the second symbol are both intersected by the first plane in both the first object position and in the second object position. This first plane may be a first vertical plane, as shown in FIGS. 4-7. As can be seen in FIG. 4, which shows a cross-sectional view of a first embodiment of the apparatus 10 as shown in FIG. 1, the container 12 of the apparatus 10 is separated into two chambers, an upper chamber 44 and a lower chamber 46. The upper chamber 44 houses the multisurfaced object 16 and includes the opening 26 through which the first surface 18 of the multisurfaced object 16 is visible. As can be seen, the upper chamber 44 also includes a gimbal 48, which is used to facilitate rotation of the multisurfaced object 16 within the upper chamber 44, as will be described in greater detail below. The lower chamber 46 of the container 12 includes the first mechanism 28 for rotating the multisurfaced object 16. This mechanism, 28 as shown in the illustrated embodiment, includes a lever 50, a plunger 52, and a spring 54. The plunger 52 includes first and second ends 56, 58, the first end 56 of which is disposed through an orifice 60 in a wall 62 separating the lower chamber 46 from the upper chamber 44. In this position, the first end 56 of the plunger 52 may contact and confront the multisurfaced object 16 in the upper chamber 44. The second end 58 of the plunger 52 is adapted to be contacted by the lever 50 of the first mechanism 28. The spring 54 is positioned between a cap 64 on the second end 58 of the plunger 52 and a contact surface 66 formed integrally with an inner surface 68 of the lower chamber 46. In FIG. 4, the spring 54 is shown in a rest position in an expanded state. The lever 50 includes a first end 70 and a second end 72. The first end 70 of the lever 50 extends through an orifice 74 in a sidewall 76 of the lower chamber 46, where it may be accessed by a user exterior of the container 12. The second end 72 of the lever 50 confronts the cap 64 of the plunger 52. In the position shown in FIG. 4, the mechanism 28 is not activated to rotate the multisurfaced object 16 within the upper chamber 44.

As described briefly above, the apparatus 10 may include a cage or gimbal 48 positioned within the interior compartment 14, the multisurfaced object 16 being positioned within said gimbal 48. The gimbal 48 works in concert with the first mechanism 28 to facilitate rotation of the multisurfaced object 16 in the first plane. For example, operation of the first mechanism 28 moves the multisurfaced object 16 in contact with an inner surface of the gimbal 48 to rotate the multisurfaced object 16 in the first plane. More specifically, the gimbal 48 inside the container 12 constrains the movement of the multisurfaced object 16. Operation of the first mechanism 28, as will be described below, forces the multisurfaced object 16 to rotate. The first surface 18 that was originally visible through the opening 26 of the container 12 is now rotated in a vertical position towards the right (as shown as an example in FIGS. 4-7) and the second surface 20 that was toward the left (as shown for example in the FIGS. 4-7) is now visible through the opening 26.

Figure 5:
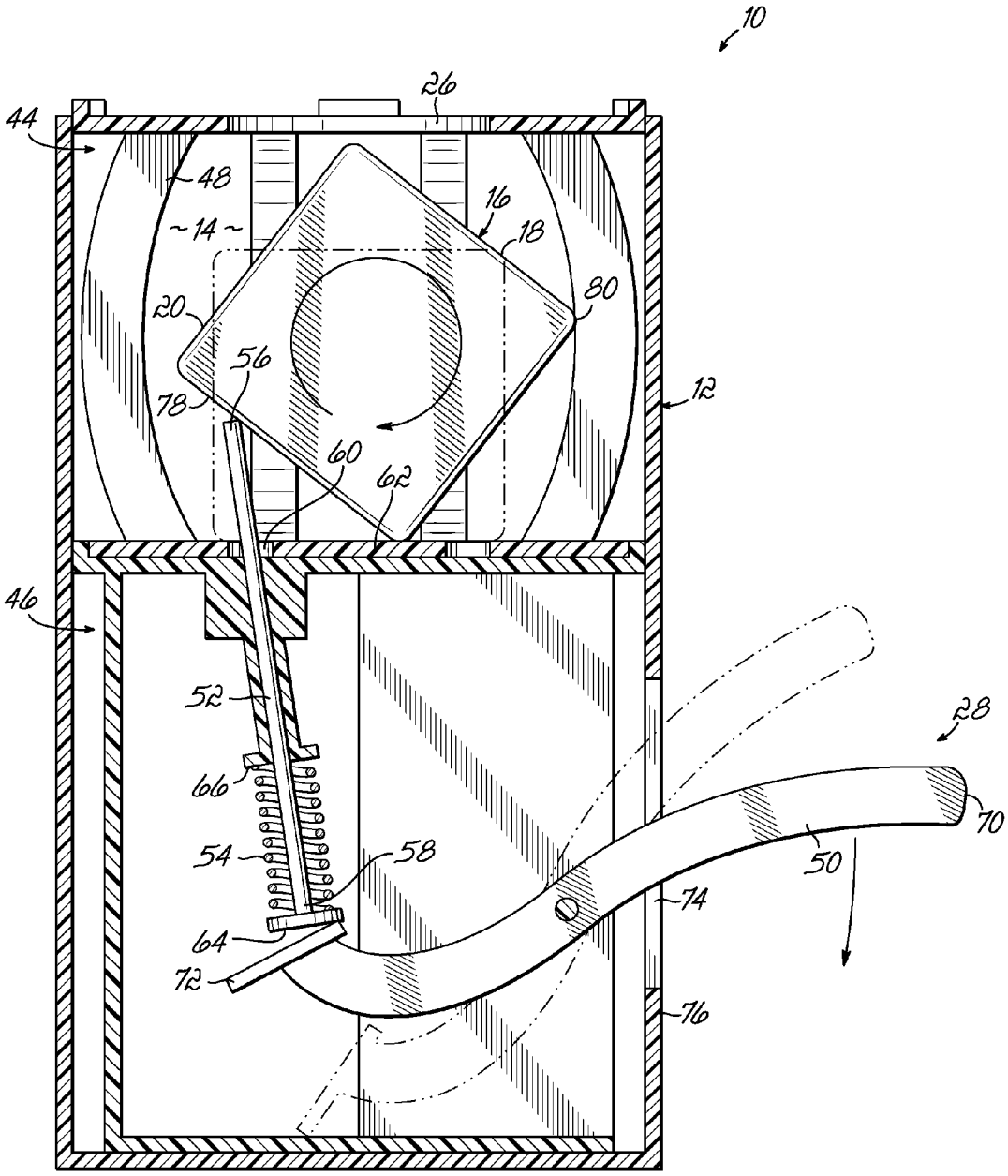
FIG. 5 is a view similar to FIG. 4, depicting the mechanism in an actuated state, and the multisurfaced object turned slightly.
Figure 6:
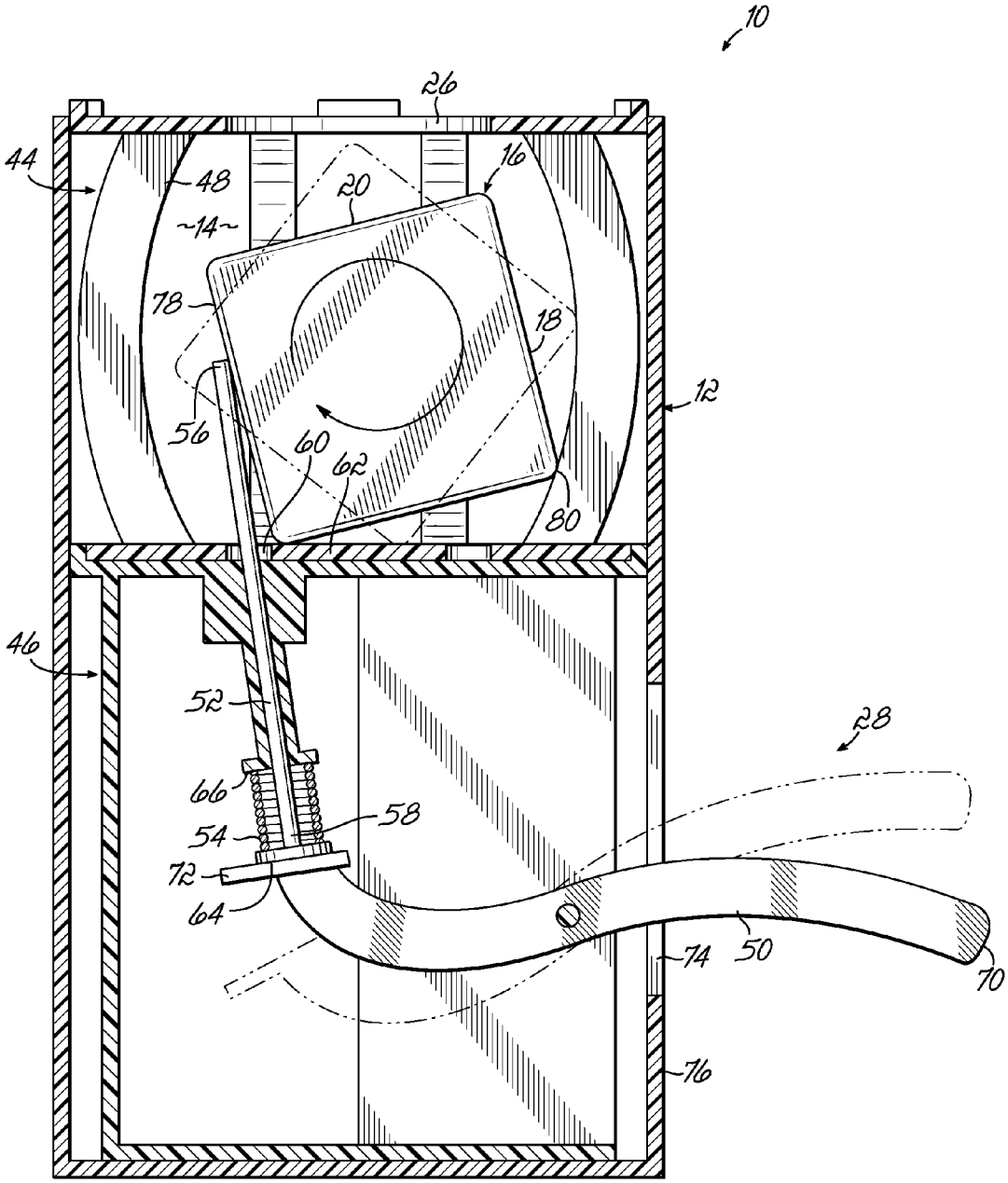
FIG. 6 is a view similar to FIG. 5, depicting the mechanism as fully actuated, and the multisurfaced object turned past center.

When a user wishes to rotate the multisurfaced object 16 in a first plane, such as a vertical plane, the user activates the mechanism 28 by pressing on the first end 70 of the lever 50, as shown in FIGS. 5 and 6. As the lever 50 is depressed at its first end 70, the second end 72 of the lever 50 contacts the cap 64 and moves the plunger 52 against the bias of the spring 54 such that the first end 56 of the plunger 52 cooperatively moves upwardly into the upper chamber 44 of the container 12. As the plunger 52 moves in this manner, the first end 56 pushes the multisurfaced object 16 at a first edge 78 thereof in an upward direction, which causes the multisurfaced object 16 to begin to tilt in the direction of application of this force. As it does, a second edge 80 of the multisurfaced object 16 contacts the gimbal 48 in the upper chamber 44, which allows the multisurfaced object 16 to fall thereagainst to complete its rotation, as shown in FIG. 6. And, as can be seen in FIG. 6, the spring 54 is now fully compressed against its bias, and the first end 56 of the plunger 52 extends at its fullest extension into the upper chamber 44.

Figure 7:
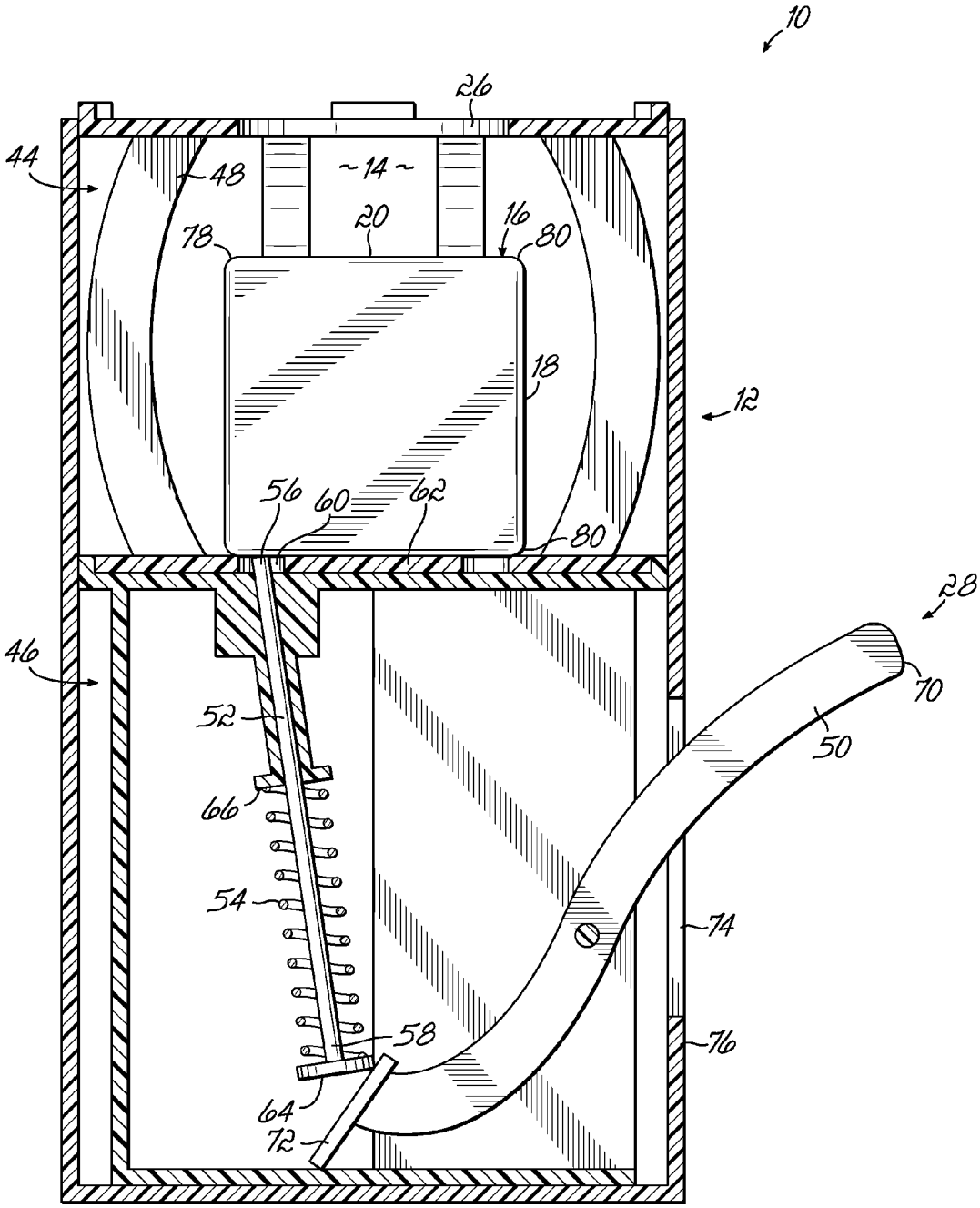
FIG. 7 is a view similar to FIG. 6, depicting the multisurfaced object turned a full 90 degrees.

As shown in FIG. 7, upon release of the lever 50, the bias of the spring 54 will cause the plunger 52 and lever 50 to return to their initial positions, with the multisurfaced object 16 now having a second surface 20 (and thus a second symbol), now visible through the opening 26 of the upper chamber 44 of the housing. Rotation of the multisurfaced object 16 can be repeated as many times as desired by activation of the first mechanism 28.

Figure 8:
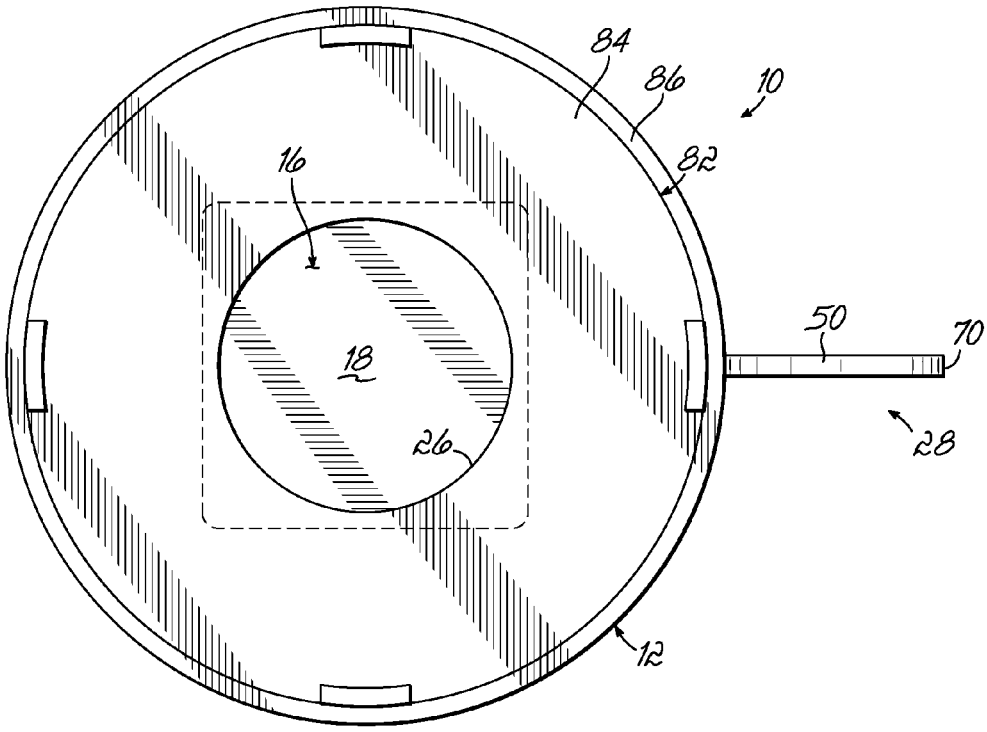
FIG. 8 is a top view of the first embodiment, showing a mechanism for moving the multisurfaced object in a second plane, such as a horizontal plane.
Figure 9:
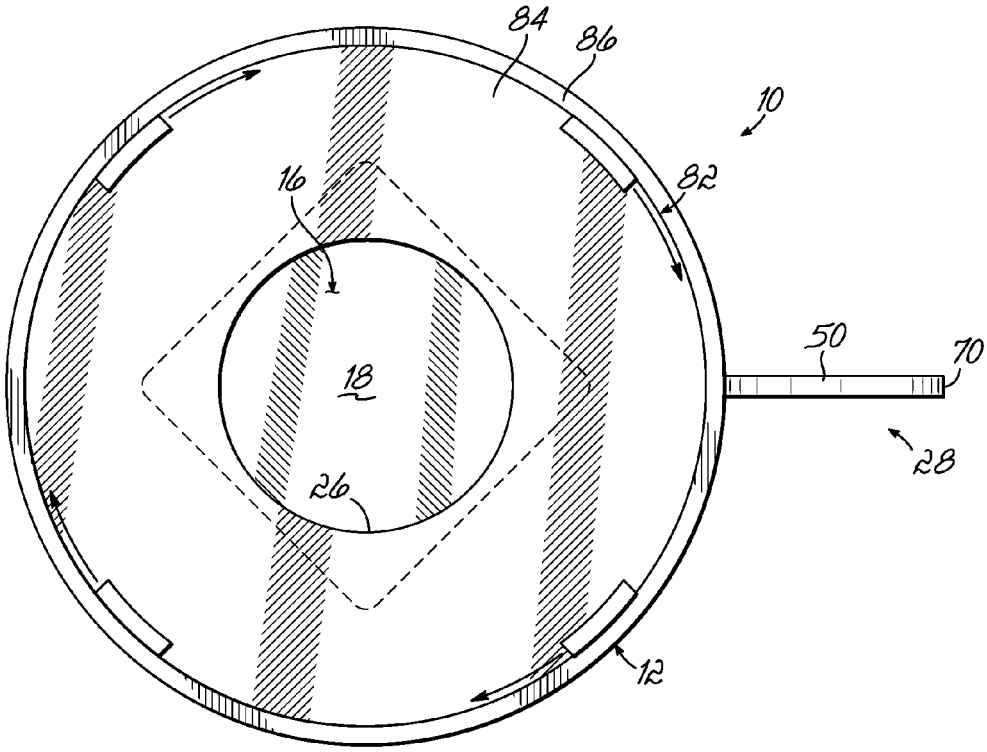
FIG. 9 is a view similar to FIG. 8, depicting the mechanism actuated, and the cube turned 45 degrees.

Referring now to FIGS. 8-9, the apparatus 10 may further comprise a second mechanism 82 adapted to relatively move the multisurfaced object 16 in a second plane (relative to the apparatus). The second plane may be substantially perpendicular to the first plane. Thus, the second mechanism 82, as in the illustrated embodiment, may include a first portion 84 of the container 12 that is movable relative to a second portion 86 of the container 12. For example, as illustrated in FIGS. 8-9, the first movable portion of the container 12 may be the upper chamber 44 of the container 12, the container 12 being in the shape of a cylindrical drum. Rotating the upper chamber 44 of the container 12 causes the multisurfaced object 16 to rotate cooperatively with the upper chamber 44. Thus, the multisurfaced object 16 rotates in a horizontal plane. More specifically, the upper chamber 44 is operatively connected to the multisurfaced object 16, such that the upper chamber 44 and the multisurfaced object 16 cooperatively move relative to the lower chamber 46, which houses a substantial portion of the first mechanism 28 for rotating the multisurfaced object 16 in the vertical plane, as described above. Thus, once rotated in the horizontal plane, the lever 50 may once again be depressed to rotate the multisurfaced object 16 again. Those skilled in the art will recognize that while rotation in the horizontal direction is described as rotating a portion of the container 12 to cooperatively rotate the multisurfaced object 16, it will be recognized that the multisurfaced object 16 is simply rotated relative to the first mechanism 28 so that the multisurfaced object 16 can be thereafter rotated by the first mechanism 28 in a different plane. Thus, those skilled in the art will recognize that the lower chamber 46 of the cylindrical drum including the first mechanism 28 may also be rotated relative to the multisurfaced object 16 and the remainder of the container 12. Further, those skilled in the art will recognize that the multisurfaced object 16 itself may solely be rotated relative to both the upper and lower chambers 44, 46.

Referring now to FIGS. 10-13, an alternate embodiment of a mechanism to move a multisurfaced object 16' is shown. In particular, a first mechanism 28' may move the multisurfaced object 16' between a first object position (shown in FIG. 10) and a second object position (shown in FIG. 13). Thus, a first surface 18', including a first symbol (not shown in FIG. 10), is visible through an opening 26' in the first object position, and a second surface 20', including a second symbol (not shown in FIG. 13), is visible through the opening 26' in the second object position. The opening 26' is adapted such that when the first symbol is visible through the opening 26', the second symbol is not visible through the opening 26'. The movement of the multisurfaced object 16' between the first object position and the second object position may be a rotational movement between the first object position and the second object position. Such motion will be described in greater detail below. However, those skilled in the art will recognize that such rotational movement is not necessary to the present invention, and any movement that suffices to move the multisurfaced object 16' from the first object position to the second object position will suffice.

Figure 10:
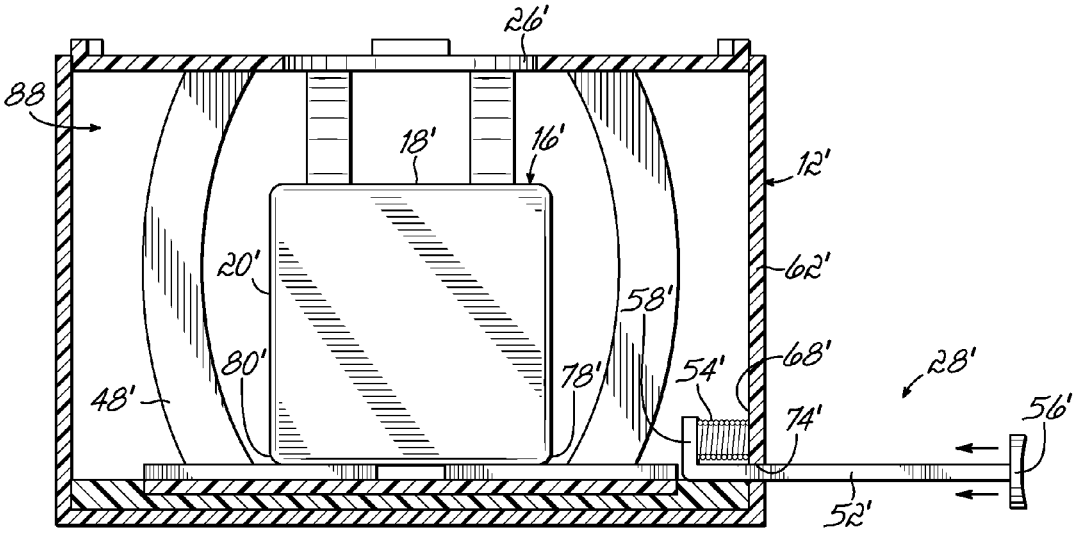
FIG. 10 is a cross-section similar to that of FIG. 4, but depicting a second embodiment of the invention.

More specifically, the first mechanism 28' is adapted to move the multisurfaced object 16' in a first plane when activated. As referred to herein, the first plane is a plane that intersects the multisurfaced object 16' as it moves from the first object position to the second object position. Thus, the surface 18' having the first symbol and the surface 20' having the second symbol are both intersected by the first plane in both the first object position and in the second object position. This first plane may be a first vertical plane, as shown in FIGS. 10-13. As can be seen in FIG. 10, the container 12' of the apparatus 10' includes only a single chamber 88. The chamber 88 houses the multisurfaced object 16' and includes the opening 26' through which the first surface 18' of the multisurfaced object 16' is visible. As can be seen, the chamber 88 also includes a gimbal 48', which is used to facilitate rotation of the multisurfaced object 16' within the chamber 88. The chamber 88 of the container 12' also includes the first mechanism 28' for rotating the multisurfaced object 16'. This mechanism 28', as shown in the illustrated embodiment, includes a plunger 52' and a spring 54'. The plunger 52' includes first and second ends 56', 58', and is disposed through an orifice 74' in a wall 62' of the chamber 88 such that a first end 56' may be accessed by a user. In this position, the second end 58' of the plunger 52' is disposed within the chamber 88, and may be moved to contact and confront the multisurfaced object 16'. A spring 54' is positioned between an inner surface 68' of a wall 62' of the chamber 88 and the second end 58' of the plunger 52'. The spring 54', at its ends, is operatively connected to the inner surface 68' of wall 62' and to the second end 58' of the plunger 52'. In FIG. 10, the spring 54' is shown in a rest position in a compressed state. The bias of the spring 54' to this rest position retains the plunger 52' in a position extended outside of the container 12', and the second end 58' does not contact the multisurfaced object 16'. In the position shown in FIG. 10, the mechanism 28' is not activated to rotate the multisurfaced 16' object within the chamber 88.

Figure 11:
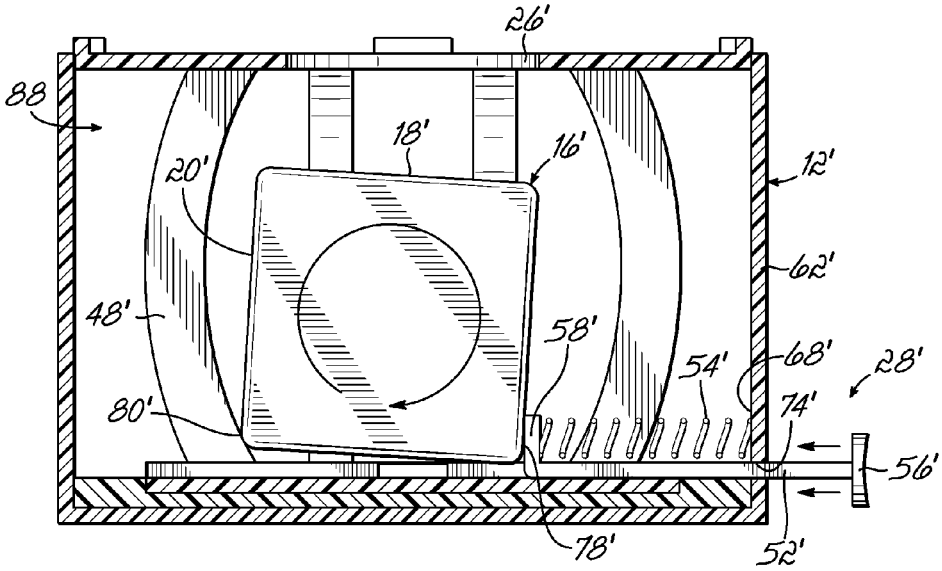
FIG. 11 is a view similar to FIG. 10, depicting the mechanism in an actuated state, and the multisurfaced object turned slightly.
Figure 12:
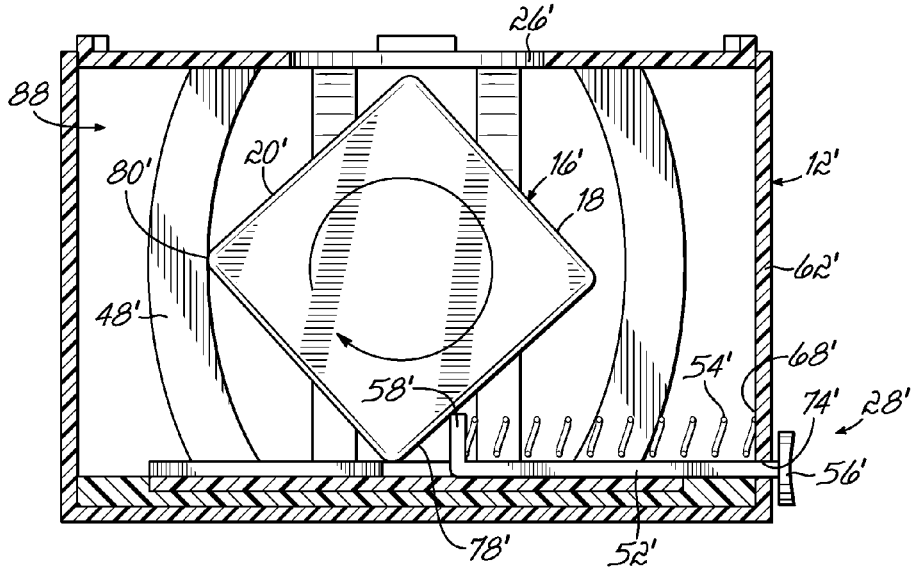
FIG. 12 is a view similar to FIG. 11, depicting the mechanism as fully actuated, and the multisurfaced object turned past center.
Figure 13:
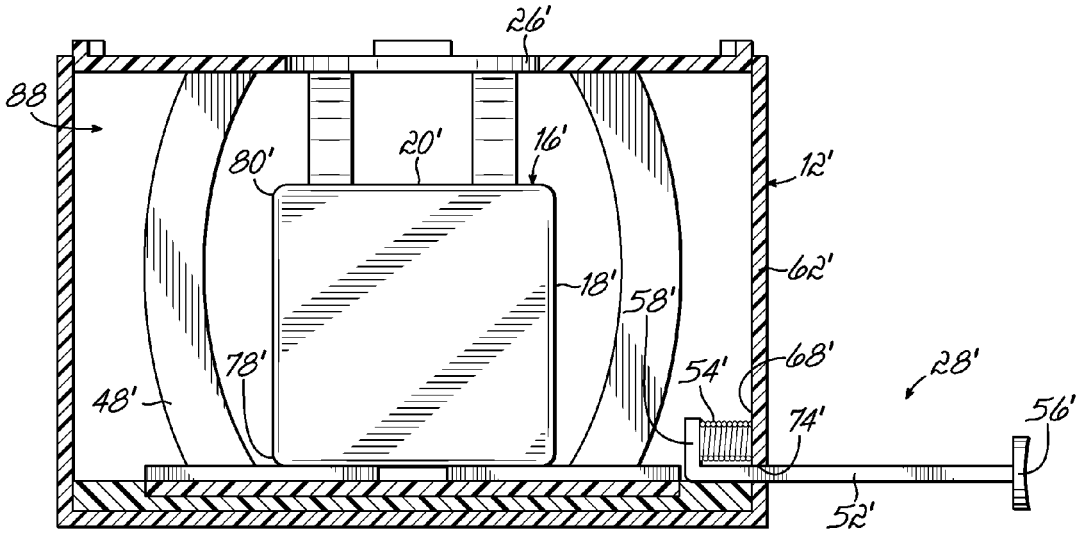
FIG. 13 is a view similar to FIG. 12, depicting the multisurfaced object turned a full 90 degrees.

When a user wishes to rotate the multisurfaced object 16' in a first plane, such as a vertical plane, the user activates the mechanism 28' by pressing on the plunger 52' in a direction opposite to the bias of the spring 54', as shown in FIGS. 11 and 12. As the plunger 52' is depressed at its first end 56', the second end 58' of the plunger 52' moves against the bias of the spring 54', such that the second end 58' of the plunger 52' contacts and pushes the multisurfaced object 16' proximal to a first edge 78' thereof, which causes the multisurfaced object 16' to begin to tilt in the direction of application of this force. As it does, a second edge 80' of the multisurfaced object 16' contacts the gimbal 48' in the chamber 88, which allows the multisurfaced object 16' to ride thereagainst to complete its rotation, as shown in FIG. 13. And, as can be seen in FIG. 13, upon completion of rotation of the multisurfaced object 16' and release of the plunger 52', the bias of the spring 54' causes the spring 54' to return to its rest position, with the first end 56' of the plunger 52' extending at its fullest extension outside the container 12'. Thus, the bias of the spring 54' will cause the plunger 52' to return to its initial position, with the multisurfaced object 16' now having a second surface 20' (and thus a second symbol 24'), now visible through the opening 26' of the container 12'.

Figure 14:
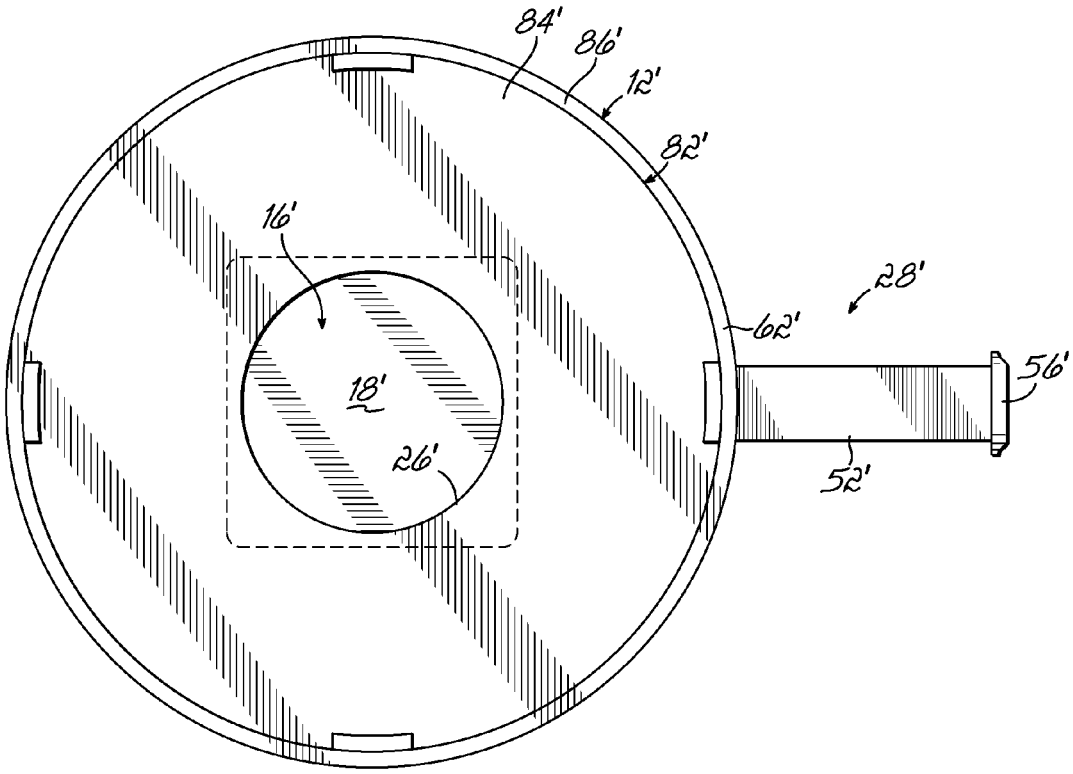
FIG. 14 is a top view of the second embodiment of the invention, depicting first and second mechanisms, one for rotating the multisurfaced object in a first plane, such as a vertical plane, and one for rotating the multisurfaced object in a second plane, such as a horizontal plane.

Referring now to FIG. 14, the apparatus 10 may further comprise a second mechanism 82' adapted to move the multisurfaced object 16' in a second plane. The second plane may be substantially perpendicular to the first plane. Thus, the second mechanism 82' may include a first portion 84' of the container 12' that is movable relative to a second portion 86' of the container 12'. For example, as illustrated in FIG. 14, the first movable portion of the container 12' may be an inner portion chamber 88 of the container 12', the container 12' being in the shape of a cylindrical drum. Rotating the chamber 88 of the container 12' causes the multisurfaced object 16' to rotate cooperatively with the chamber 88. Thus, the multisurfaced object 16' rotates in a horizontal plane. More specifically, the chamber 88 is operatively connected to the multisurfaced object 16', such that the chamber 88 and the multisurfaced object 16' cooperatively move relative to an outer portion 86' of the chamber 88, which houses a substantial portion of the first mechanism 28' for rotating the multisurfaced object 16' in the vertical plane, as described above. Thus, once rotated in the horizontal plane, the lever 52' may once again be depressed to rotate the multisurfaced object 16' again. Those skilled in the art will recognize that while rotation in the horizontal direction is described as rotating a portion of the container 12' to cooperatively rotate the multisurfaced object 16', it will be recognized that the multisurfaced object 16' is simply rotated relative to the first mechanism 28' so that the multisurfaced object 16' can be thereafter rotated by the first mechanism 28' in a different plane. Thus, those skilled in the art will recognize that the outer portion of the chamber 88 of the cylindrical drum including the first mechanism 28' may also be rotated relative to the multisurfaced object 16' and the remainder of the container 12'. Further, those skilled in the art will recognize that the multisurfaced object 16' itself may solely be rotated relative to the chamber 88.

Figure 15:
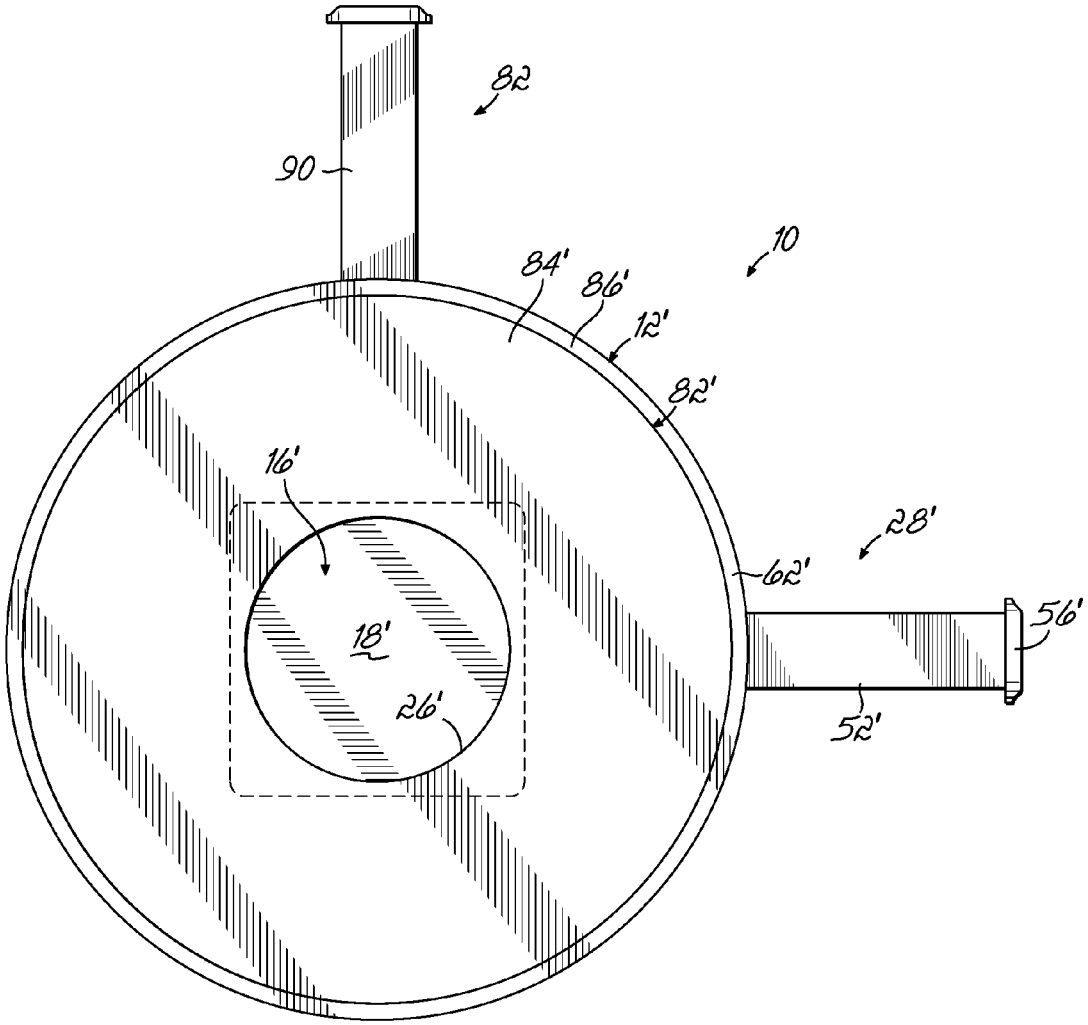
FIG. 15 is a top view of a third embodiment, depicting first and second mechanisms.

As an alternative to the embodiment described above, and referring to FIG. 15, the apparatus 10 may include a second mechanism 82 including a second lever 90 or handle that rotates the multisurfaced object 16 in a second plane, being a second vertical plane. In such an embodiment, the second mechanism 82 would operate as the first mechanism 28 of FIGS. 4-7 or the first mechanism 28' of FIGS. 10-13. In this embodiment, the second vertical plane is perpendicular to the first vertical plane.

Thus, the cylinder is equipped with two levers 52', 90 to permit the player limited rotation of the multisurfaced object 16' in two planes by manipulating the levers outside of the container 12'. The levers may be operatively connected to springs and/or plungers (not shown) inside the container 12' for rotating the multisurfaced object 16' in two vertical planes. Thus, depressing a first lever 52' rotates the multisurfaced object 16' in a first vertical plane to reveal another surface and different symbol. And instead of rotating the multisurfaced object 16' relative to the chamber of the container 12' to effect movement of the multisurfaced object 16' in the horizontal plane, as in the illustrated embodiment of FIGS. 8-9 described above, a second lever 90 is provided to rotate the multisurfaced object 16' in a different vertical plane, which is perpendicular to the first vertical plane.

Further, the difficulty or relative ease of the game apparatus 10 can be dependent on the symbols disposed on surfaces of the multisurfaced object 16. For example, if the symbols on each surface of the multisurfaced object 16 were symmetrical, they would provide no information about the relative positions of the other surfaces of the multisurfaced object 16 (for example, the square and circle shown in FIG. 2). However, if each symbol has dimensionality, for example, a top, bottom, left, and right side (such as a face), then the game will be relatively easy because the operator can more easily ascertain which way the multisurfaced object 16 faces. However, even using dimensionality, the relative ease of the game can be altered by the manner in which the symbols are ordered on the surfaces of the multisurfaced object 16. For example, the problem is made easier if the orientation of the figures "makes sense," such that both profiles are directed to the side where the front of the symbol (such as a face) appears.

While the present invention has been disclosed by reference to the details of preferred embodiments of the invention, it is to be understood that the disclosure is intended as an illustrative rather than in a limiting sense, as it is contemplated that modifications will readily occur to those skilled in the art, within the spirit of the invention and the scope of the amended claims.

What is claimed is:

1. An apparatus comprising:

a multisurfaced object including at least a first surface and a second surface, and having at least a first symbol disposed on said first surface and a second symbol disposed on said second surface;

a container having an interior compartment and an opening in said container, wherein said multisurfaced object is positioned within said interior compartment and is not connected to any structure, wherein at least said first symbol confronts said opening, and wherein said opening is adapted such that when said first symbol confronts said opening, said second symbol does not confront said opening;

a first mechanism associated with said multisurfaced object, said first mechanism adapted to rotate said multisurfaced object in a first plane; and a second mechanism adapted to rotate said multisurfaced object in a second plane;

wherein said second mechanism includes a first portion of said container that is movable relative to a second portion of said container.

2. The apparatus of claim 1, wherein said first portion and said multisurfaced object cooperatively move relative to said second portion.

3. The apparatus of claim 1, wherein said first plane is substantially perpendicular to said second plane.

4. The apparatus of claim 3, wherein said second mechanism includes a lever that rotates said multisurfaced object in said second vertical plane.

5. The apparatus of claim 1, wherein said first mechanism includes a lever that rotates said multisurfaced object in said first vertical plane.

6. The apparatus of claim 1, wherein said opening is adapted such that when said first symbol is visible through said opening, said second symbol is not visible through said opening.

7. An apparatus comprising:

a multisurfaced object including at least a first surface and a second surface, and having at least a first symbol disposed on said first surface and a second symbol disposed on said second surface;

a container having an interior compartment and an opening in said container, wherein said multisurfaced object is positioned within said interior compartment and is not connected to any structure, wherein at least said first symbol confronts said opening, and wherein said opening is adapted such that when said first symbol confronts said opening, said second symbol does not confront said opening;

a first mechanism associated with said multisurfaced object, said first mechanism adapted to rotate said multisurfaced object in a first plane; and a gimbal positioned within said interior compartment, the multisurfaced object being positioned within said gimbal, wherein the gimbal is adapted to facilitate rotation of said multisurfaced objection within said interior compartment.

8. The apparatus of claim 7, wherein operation of said first mechanism moves said multisurfaced object in contact with an inner surface of said gimbal to rotate said multisurfaced object in said first plane.

9. The apparatus of claim 7, wherein said first symbol and said second symbol are symmetrical.

10. The apparatus of claim 7, wherein said first symbol has a dimensional relationship to said second symbol.

11. The apparatus of claim 7, wherein said multisurfaced object is chosen from a cube, a dodecahedron, and an icosahedron.

12. An apparatus comprising:

a multisurfaced object including at least a first surface and a second surface, and having at least a first symbol disposed on said first surface and a second symbol disposed on said second surface;

a container having an interior compartment and an opening in said container, wherein said multisurfaced object is positioned within said interior compartment and is not connected to any structure, wherein at least said first symbol confronts said opening, and wherein said opening is adapted such that when said first symbol confronts said opening, said second symbol does not confront said opening; and a first mechanism associated with said multisurfaced object, said first mechanism adapted to result in a controlled rotation of said multisurfaced object in a first plane; wherein the sequence of rotation of said multisurfaced object is determined by the user such that there is no sequence of rotation that is preset by, as part of, or as a function of the apparatus.

13. The apparatus of claim 12, wherein at least said first symbol is visible through said opening, and wherein when said first symbol is visible through said opening, said second symbol is not visible through said opening.

* * * * *

UNITED STATES PATENT AND TRADEMARK OFFICE

CERTIFICATE OF CORRECTION

PATENT NO. : 7,850,172 B2
APPLICATION NO. : 12/506595
DATED : December 14, 2010
INVENTOR(S) : Phillip J. Best It is certified that error appears in the above-identified patent and that said Letters Patent is hereby corrected as shown below:

Column 2,
Line 20, “therefore” should be --therefor--.

Column 9,
Line 63, “amended” should be --appended--.

Column 10,
Claim 4 Line 27, “said second vertical plane” should be --said second plane--.
Claim 5 Line 30, “first vertical plane” should be --first plane--.

Signed and Sealed this
Third Day of May, 2011

David J. Kappos

David J. Kappos
*Director of the United States Patent and Trademark Office*